US006477350B1

(12) United States Patent
Nishimura

(10) Patent No.: US 6,477,350 B1
(45) Date of Patent: Nov. 5, 2002

(54) FIXATION UNIT HAVING CONTACT AND PRESSURE ROLLERS

(75) Inventor: Kazuhiro Nishimura, Mitaka (JP)

(73) Assignee: Copyer Co., Ltd., Tokyo (JP)

( * ) Notice: Subject to any disclaimer, the term of this patent is extended or adjusted under 35 U.S.C. 154(b) by 0 days.

(21) Appl. No.: 09/744,010

(22) PCT Filed: Jul. 21, 1999

(86) PCT No.: PCT/JP99/03892

§ 371 (c)(1),
(2), (4) Date: Mar. 9, 2001

(87) PCT Pub. No.: WO00/05629

PCT Pub. Date: Feb. 3, 2000

(30) Foreign Application Priority Data

Jul. 21, 1998 (JP) ..... 10-205523

(51) Int. Cl.[7] ..... G03G 15/20
(52) U.S. Cl. ..... 399/322; 399/323; 399/327
(58) Field of Search ..... 399/122, 320, 399/322, 323, 326, 327, 400; 219/216; 432/60

(56) References Cited

U.S. PATENT DOCUMENTS 4,866,485 A * 9/1989 Simpson ..... 399/323
5,047,809 A * 9/1991 Owada et al. ..... 219/216 X

FOREIGN PATENT DOCUMENTS

JP 63-78965 5/1988
JP 6-19348 1/1994

OTHER PUBLICATIONS

International Search Report.

* cited by examiner

*Primary Examiner*—William J. Royer
(74) *Attorney, Agent, or Firm*—Dellett & Walters

(57) ABSTRACT

To detach a cleaning roller 64 from a fixation unit 70, an assembly 80 is taken out from the fixation unit 70, and the cleaning roller 64 is detached from the assembly 80. Thereby, in the fixation unit 70, the operation of detaching and attaching the cleaning roller 64 for cleaning a pressure roller 46 is made easier.

6 Claims, 9 Drawing Sheets

FIXATION UNIT HAVING CONTACT AND PRESSURE ROLLERS

TECHNICAL FIELD

The present invention relates to a fixing unit which fixes a developed image having been transferred onto a recording sheet.

BACKGROUND TECHNIQUE

Electrophotographic image-forming apparatuses are used widely at the moment. The electrophotographic image-forming apparatus is explained below by reference to FIG. 6.

FIG. 6 illustrates schematically a constitution of a conventional electrophotographic image-forming apparatus.

The image forming apparatus 10 has a photosensitive drum 12 which is rotated in the arrow-A direction by a motor (not shown in the drawing). A primary electrifier 14 is provided in opposition to the photosensitive drum 12. The primary electrifier 14 electrifies uniformly the photosensitive drum 12 by corona discharge. To the uniformly electrified photosensitive drum 12, light (document-reflected light) 16 having image information of a document is projected to form an electrostatic latent image on the photosensitive drum 12.

A development unit 18 is provided after the position irradiated by the document-reflected light 16 along the rotation direction of the photosensitive drum 12 to develop the electrostatic latent image. The development unit 18 has a development sleeve 18*a* which is rotated by a motor (not shown in the drawing) in an arrow-B direction. A toner (developing agent) is fed from the development sleeve 18*a* to the photosensitive drum 12. The electrostatic latent image on the photosensitive drum 12 is moved with rotation of the drum to the position opposing the development sleeve 18*a*. There, the toner is fed from the development sleeve 18*a* to the electrostatic latent image to form a toner image (developed image) on the photosensitive drum 12.

At a timing in synchronization with the moving speed of the toner image formed on the photosensitive drum 12 registration rollers 20,20' rotate in an arrow-C or -C' direction respectively to deliver a recording sheet (not shown in the drawing) like a recording paper sheet toward an image transfer region 22. The recording sheet delivered from the registration rollers 20,20' passes through the space between an upper transfer guide plate 24 and a lower transfer guide plate 26 and reaches the photosensitive drum 12.

The recording sheet having reached the photosensitive drum 12 is then delivered to the transfer region 22. In the image transfer region 22, the toner image on the photosensitive drum 12 is transferred by a transfer electrifier 28 onto the recording sheet. Then the recording sheet is separated by a separation electrifier 30 from the photosensitive drum 12.

At the position after the transfer region 22 in the direction of rotation of the photosensitive drum 12, a cleaner 34 is provided which has a blade 32. The blade 32 scrapes a remaining toner on the photosensitive drum 12 after the image transfer.

At the position after the cleaner 34 in the direction of rotation of the photosensitive drum, an eraser 36 is provided. The eraser 36 removes residual potential remaining on the photosensitive drum 12. On the other hand, the recording sheet having received the transferred toner image is delivered by a delivery member 38 in the arrow-D direction to a fixation unit 40. In the fixation unit 40, the toner image is fixed onto the recording sheet. Thereafter the recording sheet is sent out of the apparatus to complete one copying cycle.

The fixation unit 40 is explained by reference to FIG. 7.

FIG. 7 illustrates schematically the structure of a conventional fixation unit 40.

The fixation unit 40 serves to visualize permanently the toner image on the recording sheet. The recording sheet having been delivered in the arrow-D direction by the delivery member 38 (see FIG. 6) is guided to a fixation inlet 42, and is introduced to a nip 48 between a fixation roller 44 and a pressure roller 46. The fixation roller 44 heats the recording sheet up to the fixation temperature. The fixation roller 44 is usually constituted of a pipe made of steel or aluminum, and a fluororesin coating the surface of the pipe.

The pressure roller 46 presses the recording sheet against the fixation roller 44 at a prescribed pressure. The pressure roller 46 is usually constituted of a metal core and an elastomer such as silicone rubbers and fluoro-rubbers coating the outside surface of the metal core in a prescribed thickness. The pressure roller 46 is pressed against the fixation roller 44 at a prescribed pressure to apply a load for fixing the toner image onto the recording sheet.

At the nip 48, the toner on the recording sheet is fused, and the fused toner is pressed against the recording sheet to be fixed onto the recording sheet. The recording sheet having the toner image fixed thereon is carried by rotation of the fixation roller 44 and pressure roller 46 through a sheet discharge guide having an upper separation claw 50 and a lower separation claw 52 to sheet discharge roller 54, and is discharged by the discharge rollers 54 out of the apparatus.

The fixation roller 44 and the pressure roller 46 are placed in a first casing 60. To the first casing 60, the fixation inlet or paper inlet guide 42 is attached with interposition of a guide-attaching plate 56. The upper separation claw 50, the lower separation claw 52, and the sheet discharge rollers 54 are placed in a second casing 62. The first casing 60 and the second casing 62 are separable from each other.

In the fixation process, some toner adhering to the recording sheet can be transferred to adhere to the fixation roller 44. This toner adhering to the fixation roller 44 may be transferred again to the recording sheet to stain the recording sheet. In one method to prevent this staining of the recording sheet, the toner adhering to the fixation roller 44 is transferred to the pressure roller 46, and the transferred toner is removed from the pressure roller 46 by a contact roller (cleaning roller) 64. This cleaning roller 64 may be designed to be driven by pressure contact with the pressure roller 46.

In continuous image fixation onto small-sized recording sheets, the heat of the fixation roller 44 is taken away by the passing recording sheets at the center portion, whereas at the side portions of the fixation roller 44 the heat is not taken away. With this state continued, only the end portions of the fixation roller 44 will be heated to a higher temperature, which may necessitate intermission of the copying to protect the parts near the end portions from the high temperature. In one method to avoid this, a contact roller (cleaning roller or heat radiation roller) 64 having a high thermal conductivity is brought into pressure contact with the pressure roller 46 to be driven therewith.

For space saving, the image-forming apparatus 10 (FIG. 6) may be made smaller (compactification). For this compactification, the fixation unit 40 is desirably made compact. To make compact the fixation unit, the cleaning roller (heat radiation roller) 64 is placed below the paper inlet guide 42 as shown in FIG. 7.

The aforementioned cleaning roller (heat radiation roller) 64 which becomes soiled by the toner is designed to be detachable for cleaning, or to be exchangeable. When the cleaning roller 64 is placed at the paper feed side, the cleaning roller 64 may be designed to be detachable either from the side of the discharge rollers 54, or from the side of the paper inlet guide 42.

The method of detaching the cleaning roller 64 is explained with reference to FIGS. 8 and 9.

FIG. 8 illustrates schematically a method of detaching the cleaning roller 64 from the side of the sheet-discharge rollers 54. FIG. 9 illustrates schematically a method of detaching the cleaning roller 64 from the side of the paper inlet guide 42.

To detach the cleaning roller 64 from the side of the sheet discharge rollers 54, firstly the second casing 62 is separated from the first casing 60; the pressure roller 46 is detached from the first casing 60; and the cleaning roller 65 is detached from the inner part of the first casing 60. In this method of detaching the cleaning roller 64 from the side of the sheet discharge rollers 54, several detaching operations should be conducted, which is laborious, disadvantageously.

On the other hand, to detach the cleaning roller 64 from the side of the paper inlet guide 42, the paper inlet guide 42 and the guide-attaching plate 56 are removed together simultaneously; and then the cleaning roller 64 is detached. Therefore, the operation itself of detaching the cleaning roller 64 is simpler than the detaching operation of the cleaning roller 64 form the side of the sheet discharge rollers 54.

However, the setting position of the paper inlet guide 42 is adjusted for each of the units to guide the recording sheet surely to the nip 48. Therefore, after attaching of the cleaned or replaced cleaning roller 64 in the first casing 60, the position of the paper inlet guide 42 should be adjusted again. This is an additional laborious operation.

DISCLOSURE OF THE INVENTION

The object of the present invention is to provide a fixation unit which has a contact roller attachable and detachable readily for cleaning or exchange, and is inexpensive.

A first embodiment of the fixation unit of the present invention, to achieve the above object, has a fixation roller having a built-in heater, a pressure roller pressed against the fixation roller and driven thereby, a casing in which the fixation roller and the pressure roller are incorporated, and a paper inlet guide for guiding a recording sheet to a nip between the fixation roller and the pressure roller to fix a developed image transferred onto the recording sheet, wherein the fixation unit comprises (1) a metal base plate having the paper inlet guide held thereon movably in vertical directions, and being attached at a predetermined position in the casing, and
(2) a contact roller being attached to the metal base plate and being in contact with the pressure roller.

A second embodiment of the fixation unit of the present invention, to achieve the above object, has a fixation roller having a built-in heater, a pressure roller pressed against the fixation roller and driven thereby, a casing in which the fixation roller and the pressure roller are incorporated, and a lower sheet discharge guide plate for guiding a recording sheet discharged from a nip between the fixation roller and the pressure roller to fix a developed image transferred onto the recording sheet; wherein the fixation unit comprises (3) a contact roller in contact with the lower sheet discharge guide plate,
(4) a lower separation claw attached to the lower sheet discharge guide plate for separating the recording sheet from the. pressure roller, and
(5) the lower sheet discharge guide plate, the contact roller, and the lower separation claw are detachable in integration from the casing.

The fixation unit (6) may have a bearing holder which is integrated with the paper inlet guide and supports the contact roller to be movable in the contact direction, and
(7) the paper inlet guide and the bearing holder may be made of a resin.

The contact roller (8) may be a cleaning roller for cleaning the pressure roller, or a heat radiating roller for absorbing and radiating the heat of the pressure roller.

BSET MODE FOR PRACTICING THE INVENTION

The fixation unit of the present invention is explained by reference to the drawings.

[First Embodiment]

Figure 2:
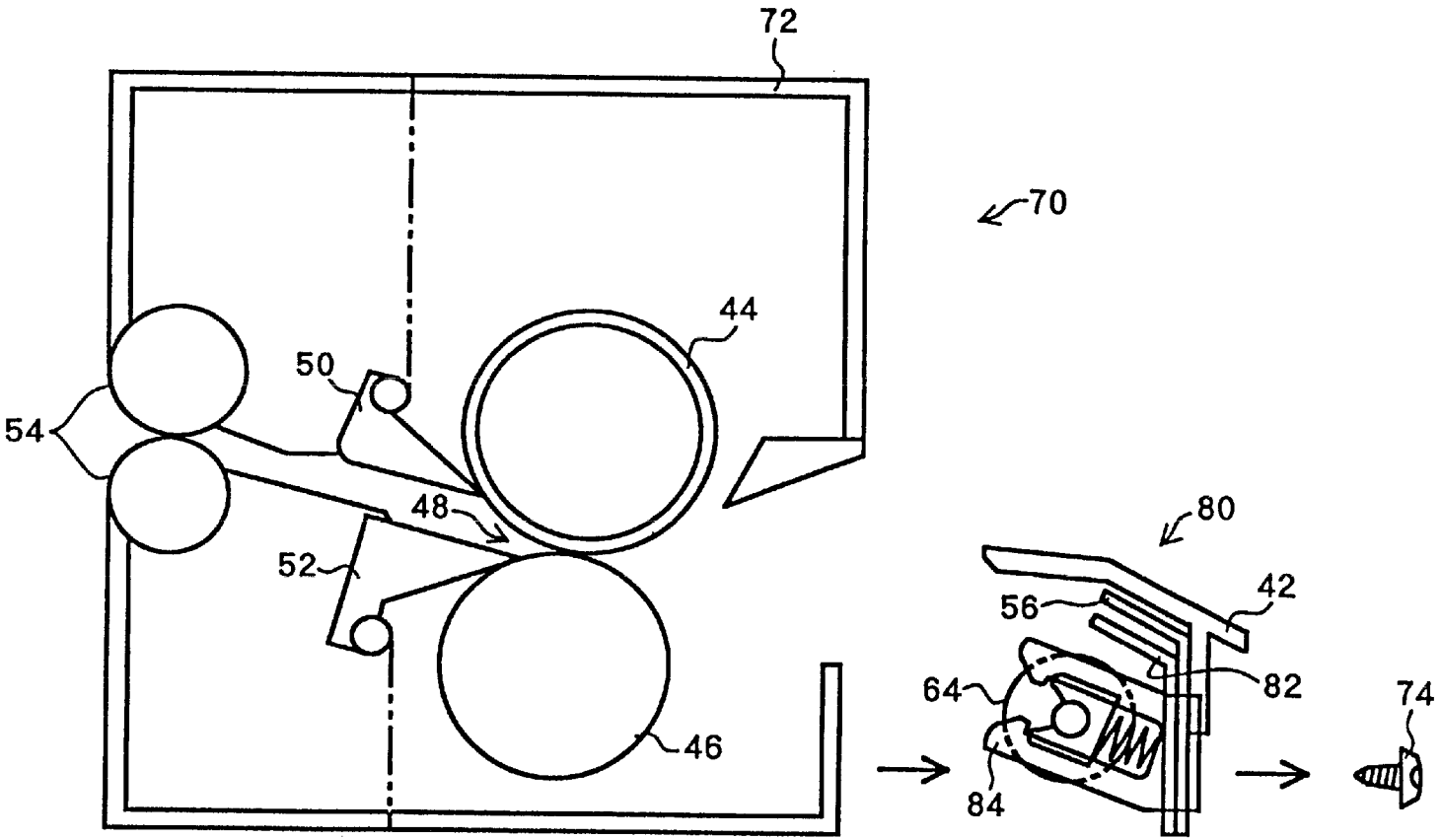
FIG. 2 illustrates schematically a state of the fixation unit with the paper inlet guide and the contact roller detached.
Figure 3:
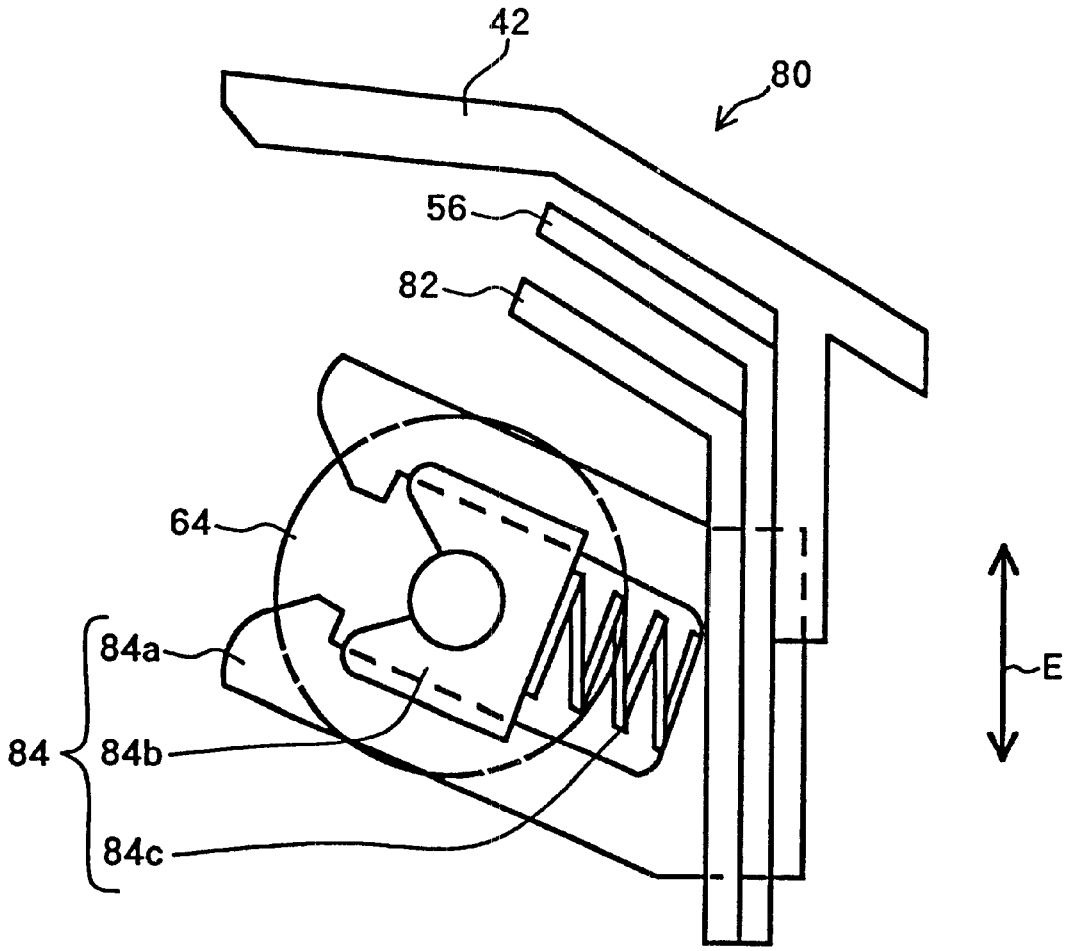
FIG. 3 illustrates the detached paper inlet guide and the detached contact roller.

A first embodiment of the fixation unit of the present invention is explained by reference to FIGS. 1, 2, and 3.

Figure 1:
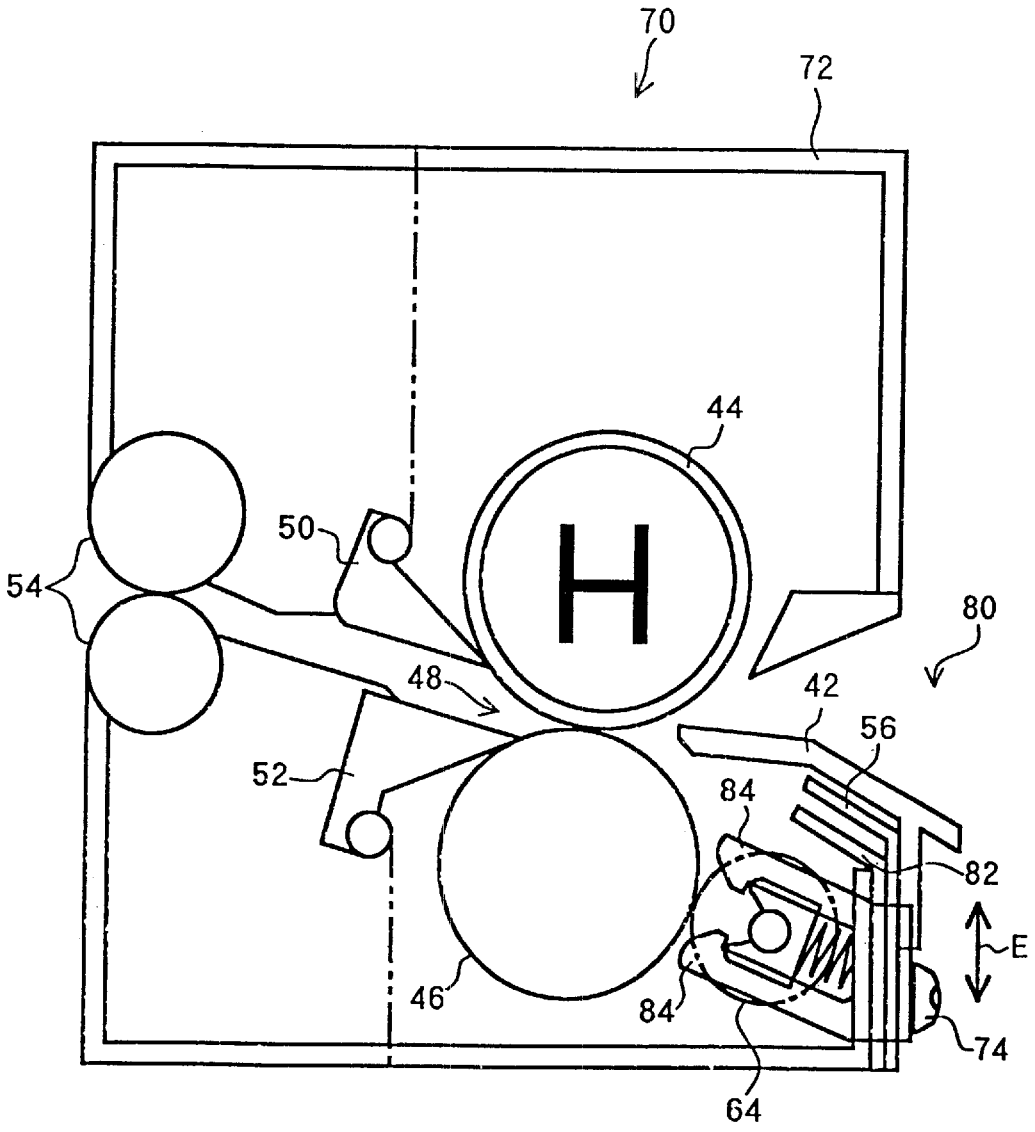
FIG. 1 illustrates schematically a constitution of a first embodiment of the fixation unit of the present invention.
Figure 7:
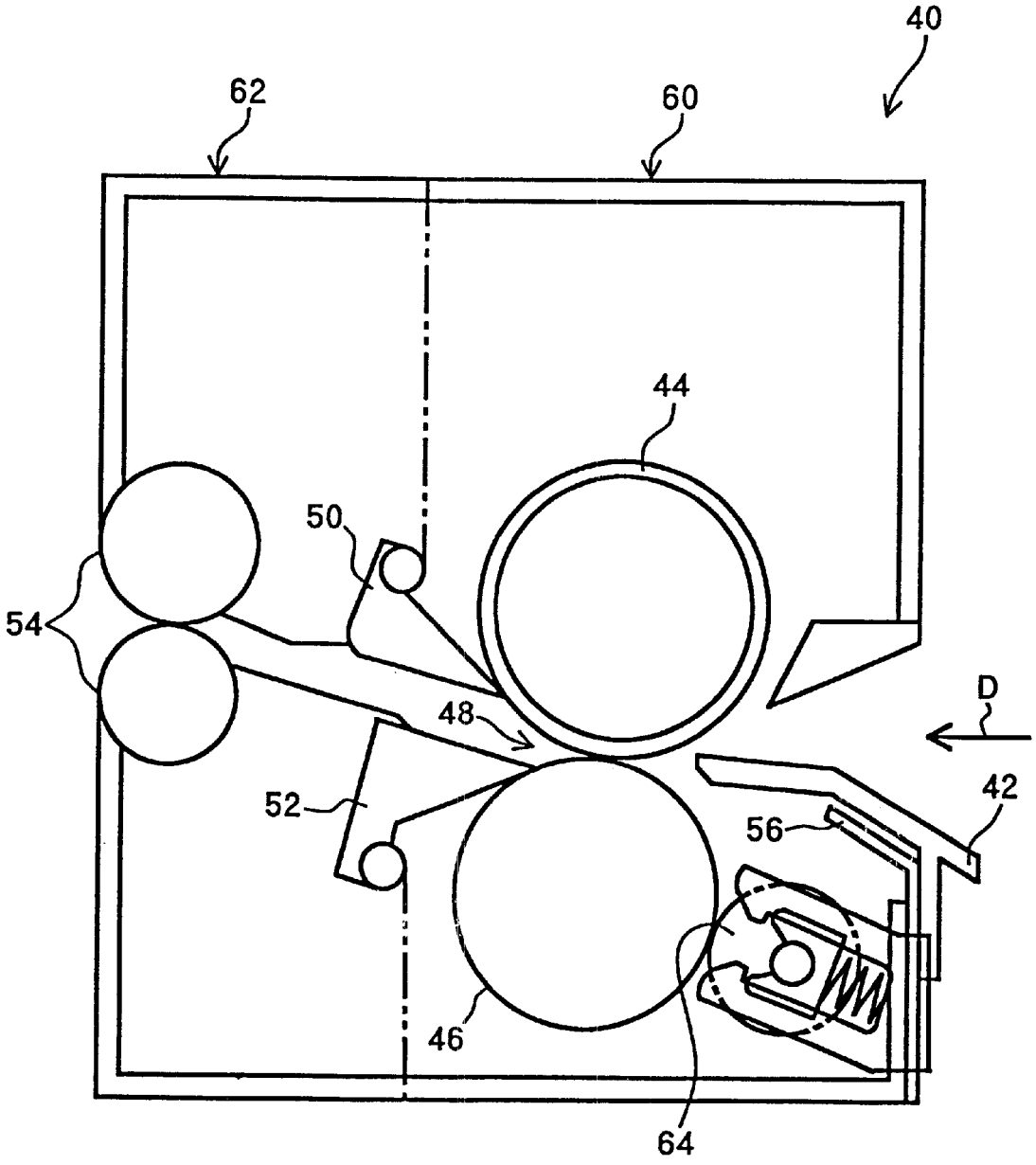
Fig.7 PRIOR ART
FIG. 7 illustrates schematically a conventional fixation unit.
Figure 8:
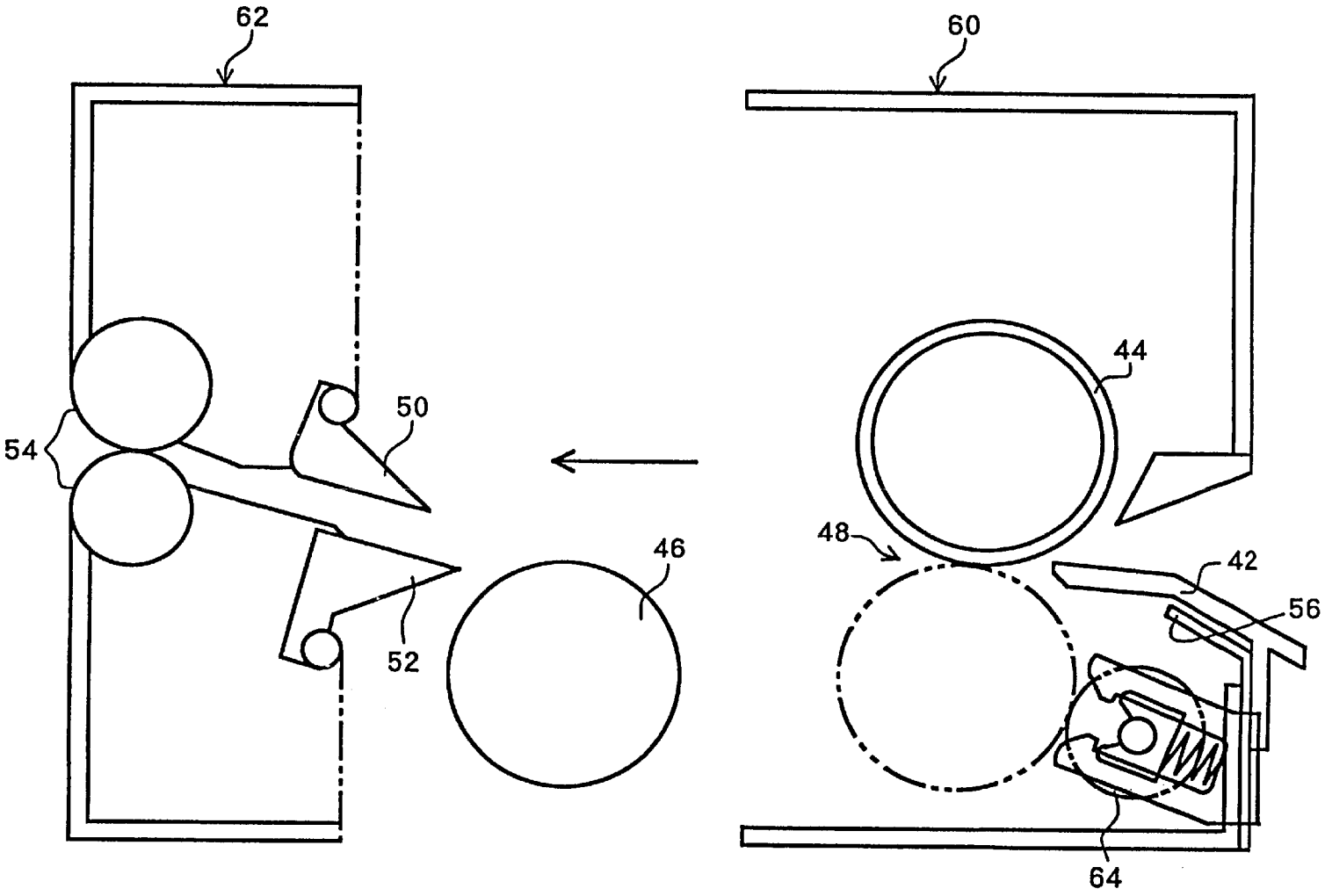
Fig.8 PRIOR ART
FIG. 8 illustrates schematically a method of detaching the cleaning rollers from-the sheet discharge roller side.
Figure 9:
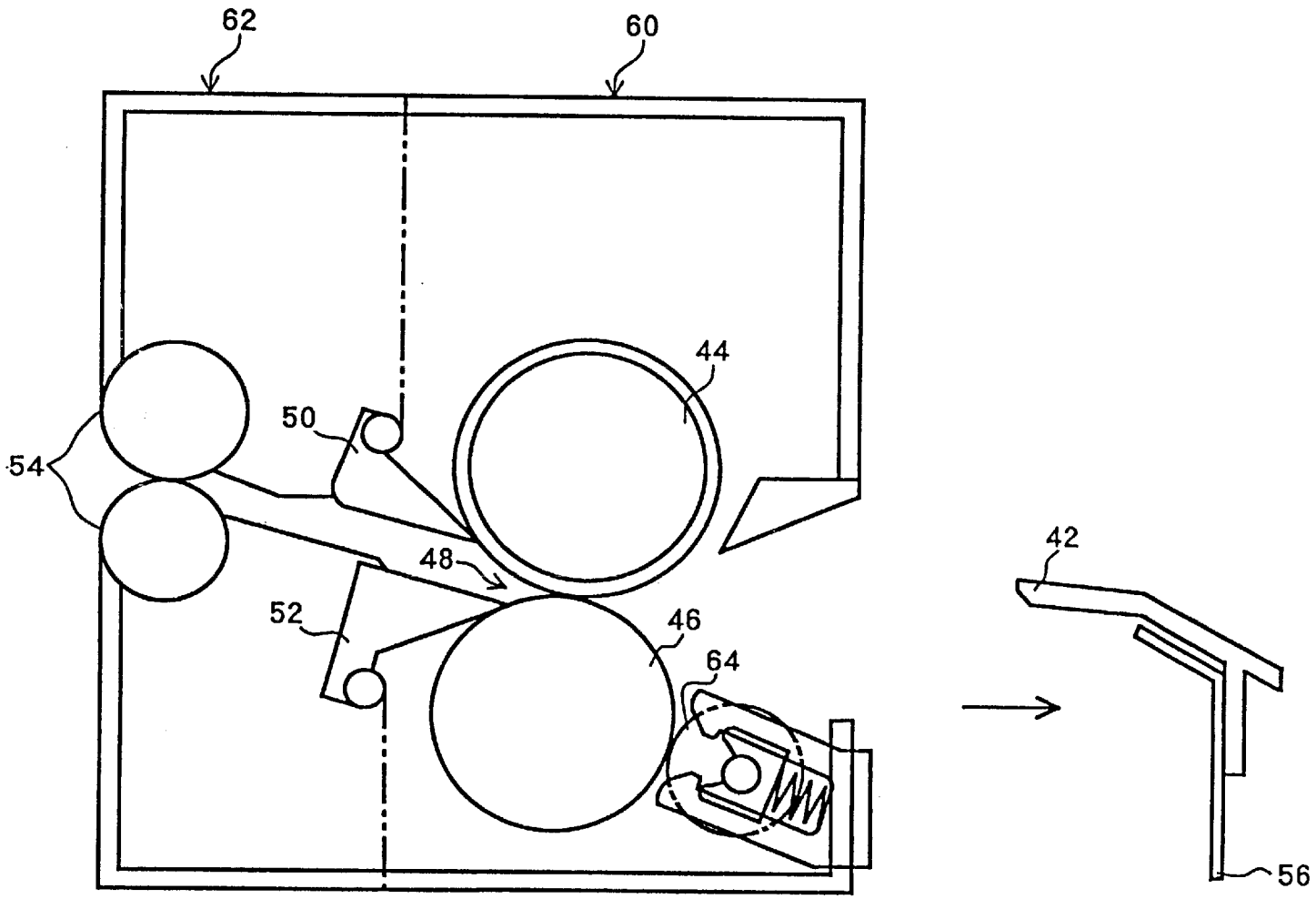
Fig.9 PRIOR ART
FIG. 9 illustrates schematically a method of detaching the cleaning roller from the paper inlet guide side.

FIG. 1 illustrates schematically a constitution of the first embodiment of the fixation unit. FIG. 2 illustrates schematically a state of the fixation unit with the paper inlet guide and the contact roller detached. FIG. 3 illustrates the detached paper inlet guide and the detached contact roller. In these drawings, the same reference numbers are used for the corresponding constitutional elements as in FIGS. 7–9.

In the present invention, either of a cleaning roller and a heat radiation roller having a function different from each other is employed as the contact roller. However, the two rollers are the same in the constitution of contact with the pressure roller. Therefore, the explanation below is made for use of the cleaning roller as the example.

The fixation unit 70 has an assembly 80 constituted of a paper inlet guide 42, a cleaning roller 64, and so forth as an integrated unit. The assembly 80 is attached fixedly by a screw 74 detachably to the casing 72 of the fixation unit 70. Therefore, the assembly 80 can be detached readily from the casing 72 by taking off the screw 74.

The assembly 80 has a metal base plate 82 folded at an obtuse angle. The position of fitting the metal base plate 82 to the casing 72 by the screw 74 is decided by embossing or a like positioning method. To the metal base plate 82, a guide attaching plate 56 is fitted which has nearly the same shape as the metal base plate 82. The position of fitting the guide attaching plate 56 to the metal base plate 82 is shiftable in a vertical direction (arrow-E direction). To a guide attaching plate 56, a paper inlet guide 42 is folded at an obtuse angle. To the metal base plate 82, a bearing set 84 is fitted which holds the cleaning roller 64 rotatably. The bearing set 84 is constituted of a bearing holder 84*a* for holding a bearing 84*b* slidably and a compression coil spring 84*c* for energizing the bearing 84*b* toward the pressure roller 46.

To detach the cleaning roller 64 from the fixation unit 70 for cleaning or exchange, the assembly 80 is detached from the fixation unit 70, and the cleaning roller 64 is detached from the assembly 80. Thereby, in this fixation unit 70, the cleaning roller 64 can readily be detached and attached for cleaning or exchange.

The position of the paper inlet guide 42 relative to the nip 48 should be adjusted appropriately to prevent clogging with paper introduced by the paper inlet guide 42, or a like trouble. Therefore, the adjustment of the height of the paper inlet guide 42 is important. This height is adjusted by shifting the guide attaching plate 56. As described above, the metal base plate 82 is attached to a prescribed position of the casing 72, and the paper inlet guide 42 is attached to a prescribed position of the guide attaching plate 56. Therefore, the height of the paper inlet guide 42 can readily be adjusted by adjusting the fitting position of the guide attaching plate 56 to the metal base plate 82. The metal base plate 82 having been detached from the casing 72 for cleaning or exchange of the cleaning roller 64 comes naturally to be fitted again to the same prescribed position, so that the position of the inlet guide 42 cannot be changed.

[Second Embodiment]

In the above first embodiment, the paper inlet guide 42 and the bearing holder 84*a* are constituted integrally. On the other hand, in the second embodiment, the paper inlet guide 42 itself supports the cleaning roller 64. The bearing holder 84*a*, which is placed near the pressure roller 46, is made of a heat-resistant expensive resin. The paper inlet guide 42, which is placed near the fixation roller 44, is also made of a heat-resistant expensive resin. Therefore, the paper inlet guide 42 and the bearing holder 84*a* can be integrated, which lowers the cost in comparison with the separate constitution.

[Third Embodiment]

A third embodiment of the fixation unit of the present invention is explained by reference to FIGS. 4 and 5.

Figure 4:
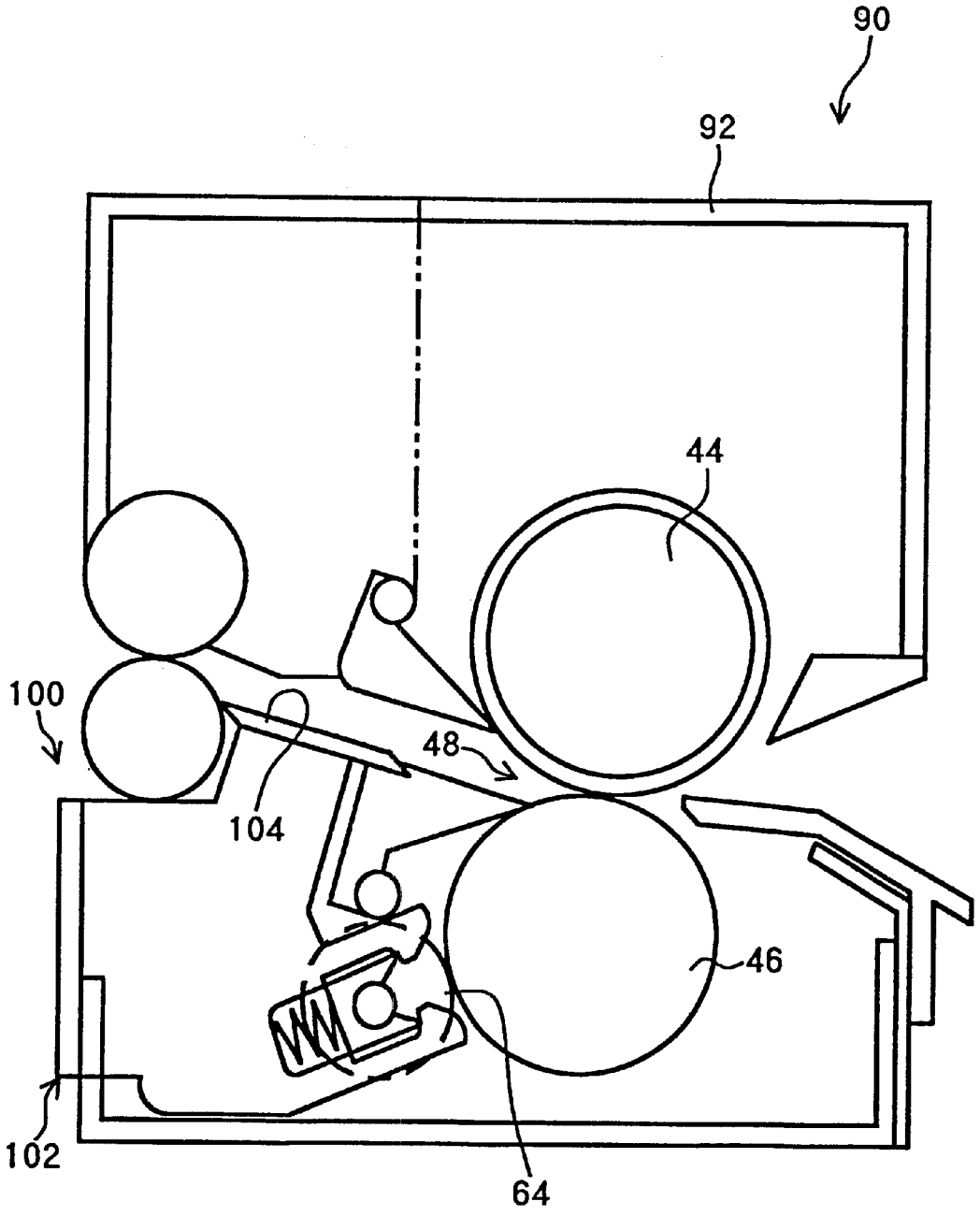
FIG. 4 illustrates schematically a constitution of a third embodiment of the fixation unit of the present invention.
Figure 5:
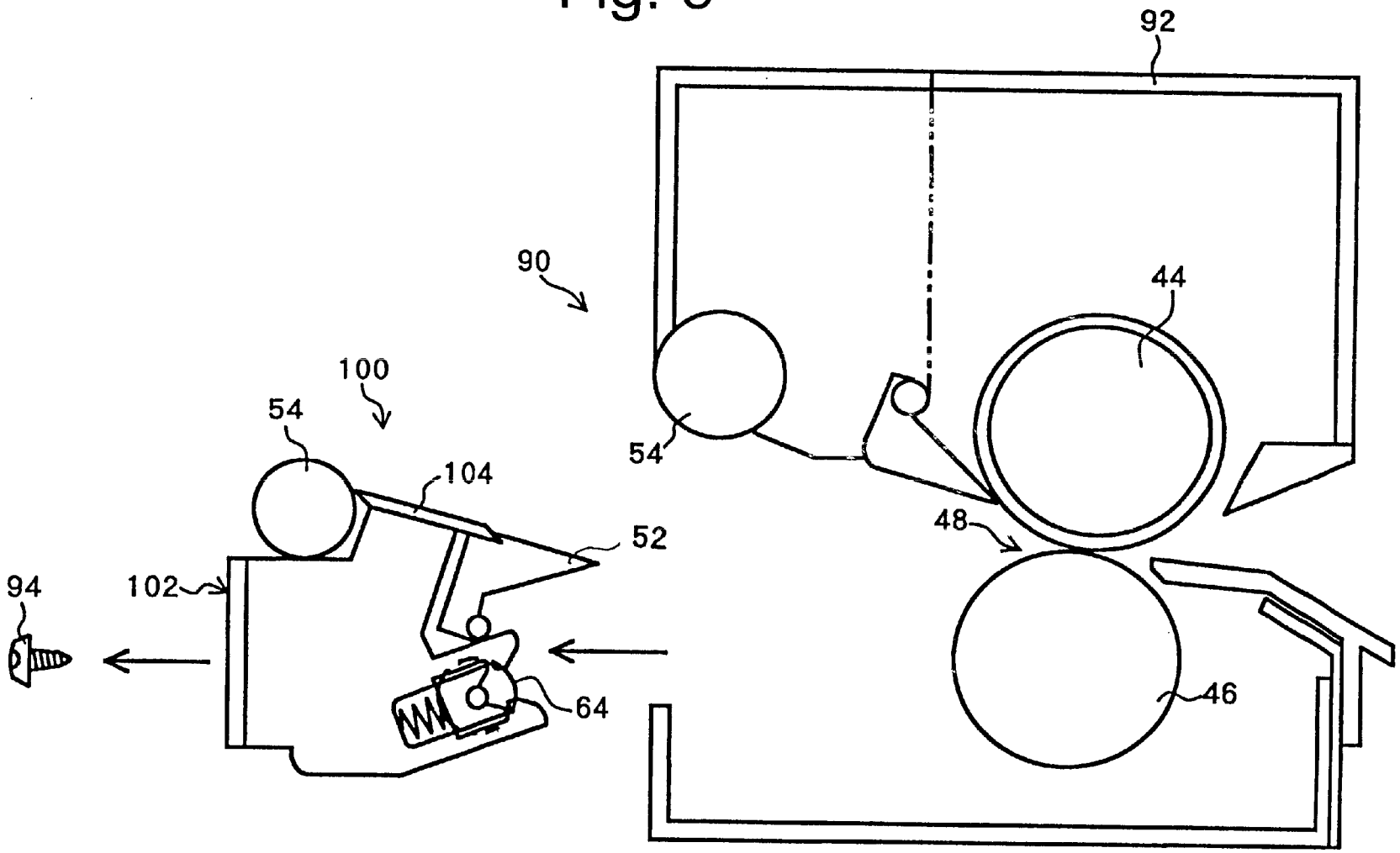
FIG. 5 illustrates schematically a state of the fixation unit with the lower sheet discharge guide and the cleaning roller detached.
Figure 6:
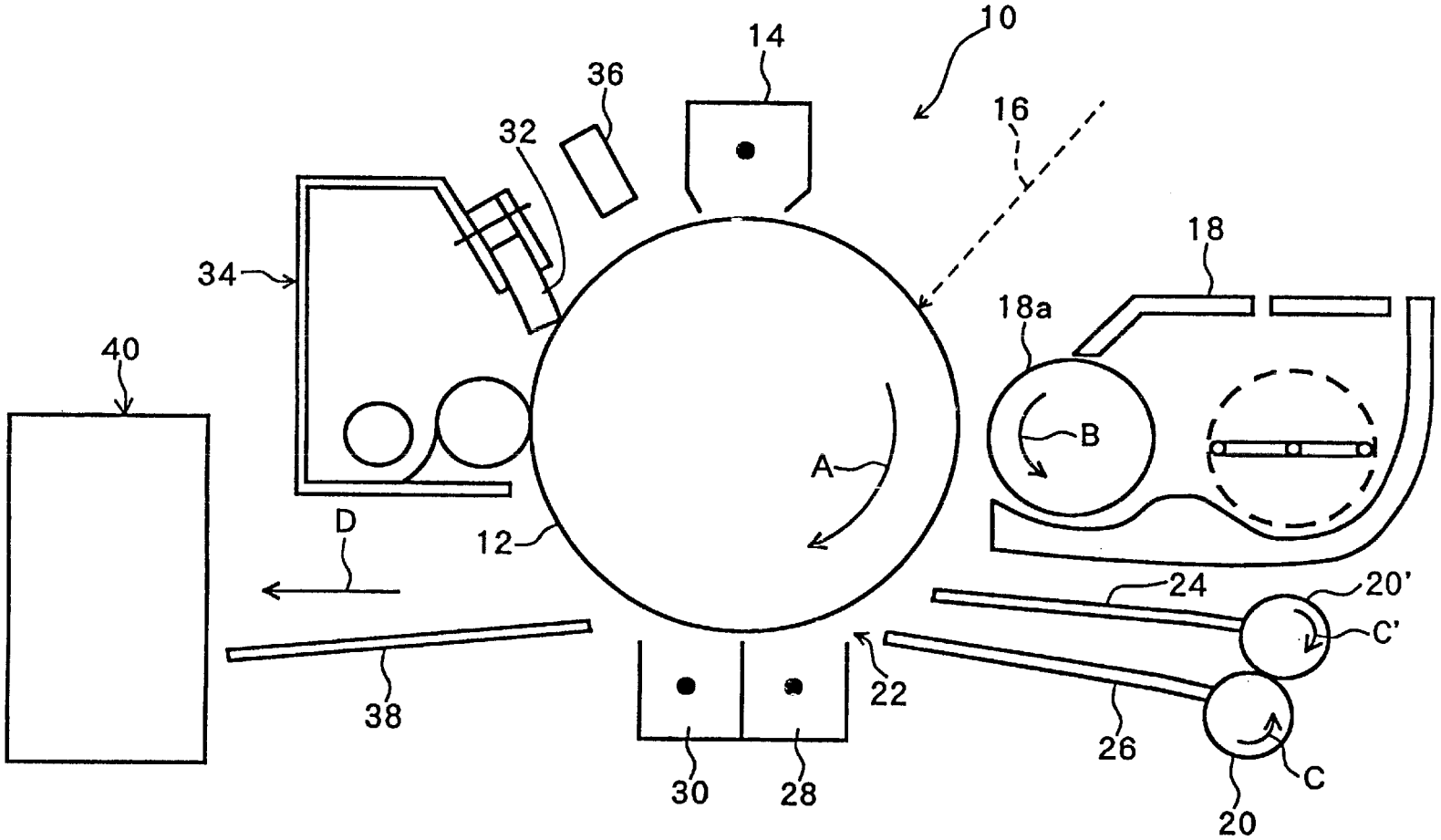
Fig.6 PRIOR ART
FIG. 6 illustrates schematically a conventional electrophotographic image forming apparatus.

FIG. 4 illustrates schematically a constitution of the third embodiment of the fixation unit of the present invention. FIG. 5 illustrates schematically a state of the fixation unit with the lower sheet discharge guide and the cleaning roller detached. In these drawings, the same reference numbers are used for the corresponding constitutional elements as in FIGS. 7–9.

The fixation unit 90 is provided with an assembly 100 comprising a lower sheet discharge guide (an example of sheet discharge guide in the present invention) 102, cleaning roller 64, and so forth as an integrated unit. The assembly 100 is attached by a screw 94 to a casing 92 of the fixation unit 90. Therefore, the assembly 100 can readily be detached from the casing 92 by removing the screw 94. The assembly 100 comprises the lower sheet discharge guide 102 having a lower sheet discharge guide plate 104, a lower separation claw 52, and the cleaning roller 64 attached detachably below the lower sheet discharge guide plate 104. In the assembly 100, one of a pair of sheet discharge rollers 54 is attached rotatably . The toner and paper dust adhering to the pressure roller 46 will come to stick to the lower separation claw 52, so that the lower separation claw 52 should be cleaned or exchanged periodically.

To detach the cleaning roller 64 from the fixation unit 90 for cleaning or exchange, the assembly 100 is detached from the fixation unit 90, and the cleaning roller 64 is detached from the assembly 100. Therefore, with the fixation unit 90, plural parts to be cleaned or exchanged can be detached simultaneously, thereby the efficiency of cleaning or exchange is improved.

INDUSTRIAL APPLICABILITY

As described above, the first embodiment of the fixation unit of the present invention has the contact roller and the paper inlet guide in integration. Therefore, in detaching the contact roller, the contact roller can be detached together with the paper inlet guide, which facilitates the operation of cleaning or exchange of the contact roller.

The second embodiment of the fixation unit of the present invention has the contact roller supported by the paper inlet guide, whereby the cost of the fixation unit is lowered.

The third embodiment of the fixation unit of the present invention has the contact roller and the sheet discharge guide in integration. Therefore, the cleaning roller and the lower separation claw can be detached together simultaneously, which facilitates the cleaning or exchange of the cleaning roller and the lower separation claw.

What is claimed is:

1. A fixation unit having a fixation roller having a built-in heater, a pressure roller pressed against the fixation roller and driven thereby, a casing in which the fixation roller and the pressure roller are incorporated, and a paper inlet guide for guiding a recording sheet to a nip between the fixation roller and the pressure roller to fix a developed image transferred onto the recording sheet, wherein said fixation unit comprises;

a metal base plate having the paper inlet guide held thereon movably in vertical directions, and being attached at a predetermined position in the casing, and a contact roller being attached to the metal base plate and being in contact with the pressure roller.

2. The fixation unit according to claim 1, wherein the fixation unit has a bearing holder which is integrated with the paper inlet guide and supports the contact roller to be movable in the contact direction, and the paper inlet guide and the bearing holder are made of a resin.

3. The fixation unit according to claim 2, wherein the contact roller is a cleaning roller for cleaning the pressure roller, or a heat radiation roller for absorbing and radiating the heat of the pressure roller.

4. The fixation unit according to claim 1, wherein the contact roller is a cleaning roller for cleaning the pressure roller, or a heat radiation roller for absorbing and radiating the heat of the pressure roller.

5. A fixation unit having a fixation roller having a built-in heater, a pressure roller pressed against the fixation roller and driven thereby, a casing in which the fixation roller and the pressure roller are incorporated, and a sheet discharge guide having a lower sheet discharge guide plate for guiding a recording sheet discharged from a nip between the fixation roller and the pressure roller to fix a developed image transferred onto the recording sheet, wherein said fixation unit comprises a contact roller in contact with the lower sheet discharge guide plate, a lower separation claw attached to the lower sheet discharge guide plate for separating the recording sheet from the pressure roller, and the lower sheet discharge guide plate, the contact roller, and the lower separation claw are detachable in integration from the casing.

6. The fixation unit according to claim 5, wherein the contact roller is a cleaning roller for cleaning the pressure roller, or a heat radiation roller for absorbing and radiating the heat of the pressure roller.

* * * * *